US009416985B2

(12) United States Patent
Tom

(10) Patent No.: US 9,416,985 B2
(45) **Date of Patent: *Aug. 16, 2016**

(54) 50/60 CFM BATH EXHAUST FANS WITH FLAPS/EARS THAT ALLOW HOUSINGS TO BE MOUNTED TO JOISTS

(71) Applicant: Chien Luen Industries, Co., Ltd., Inc., Oakland Park, FL (US)

(72) Inventor: Lawrence Tom, Smryna, GA (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/816,914

(22) Filed: Aug. 3, 2015

(65) Prior Publication Data

US 2015/0338115 A1 Nov. 26, 2015

Related U.S. Application Data

(63) Continuation of application No. 13/233,700, filed on Sep. 15, 2011, now Pat. No. 9,097,265.

(60) Provisional application No. 61/383,813, filed on Sep. 17, 2010.

(51) Int. Cl.

| | |
|---|---|
| ***F04D 29/62*** | (2006.01) |
| ***F24F 7/007*** | (2006.01) |
| ***F24F 7/06*** | (2006.01) |

(Continued)

(52) U.S. Cl.

CPC ..... *F24F 7/007* (2013.01); *F04D 25/088* (2013.01); *F04D 29/4226* (2013.01); *F04D 29/624* (2013.01); *F04D 29/626* (2013.01); *F24F 7/06* (2013.01); *F24F 13/20* (2013.01); *F24F 2013/205* (2013.01)

(58) Field of Classification Search

CPC . F04D 29/626; F04D 29/4226; F04D 25/088; F24F 7/007; F24F 7/06; F24F 13/20; F24F 2013/205

USPC ..... 415/213.1, 214.1, 206, 203; 454/254, 454/349; 416/244 R, 246; 417/423.15, 417/424.1, 424.2, 360; 248/200, 201, 248/220.1, 300, 316.8

See application file for complete search history.

(56) References Cited

U.S. PATENT DOCUMENTS

| | | | |
|---|---|---|---|
| 1,823,479 | A | 9/1931 | Venderbush |
| 2,519,503 | A | 8/1950 | Rigaumont |

(Continued)

OTHER PUBLICATIONS

Tom, Lawrence, Office Action Summary mailed Nov. 7, 2014 for U.S. Appl. No. 13/289,312, filed Nov. 4, 2011, 14 pages.

(Continued)

*Primary Examiner* — Christopher Verdier

(74) *Attorney, Agent, or Firm* — Brian S. Steinberger; Law Offices of Brian S. Steinberger, P.A.

(57) ABSTRACT

Apparatus, systems and methods of 50/60 CFM exhaust and ventilation fans for bathrooms with flaps/ears that allow the housings to mount directly to joists and/or other structural members inside of a ceiling or inside of a wall. The housing can include a mounting plate having a motor with attached impeller thereon, wherein the mounting plate with motor and attached impeller can be removed as a single unit from the housing for accessing and inspecting interior wire connections during inspection and for ease in replacing parts such as burned out motors overtime.

17 Claims, 11 Drawing Sheets

(51) Int. Cl.

| | |
|---|---|
| ***F04D 29/42*** | (2006.01) |
| ***F04D 25/08*** | (2006.01) |
| ***F24F 13/20*** | (2006.01) |

(56) References Cited

U.S. PATENT DOCUMENTS

| | | | |
|---|---|---|---|
| 2,689,906 | A | 9/1954 | Corbett |
| 2,697,163 | A | 12/1954 | Spear |
| 2,950,859 | A | 8/1960 | Kirk |
| 3,068,341 | A | 12/1962 | Ortiz |
| 3,125,943 | A | 3/1964 | Geocaris |
| 3,246,137 | A | 4/1966 | Zagel |
| 3,665,838 | A | 5/1972 | Shepherd |
| 3,785,271 | A | 1/1974 | Joy |
| 4,510,851 | A | 4/1985 | Sarnosky |
| 4,526,318 | A | 7/1985 | Fleming |
| 4,537,117 | A | 8/1985 | Cavestany |
| 4,589,476 | A | 5/1986 | Berner |
| 4,657,291 | A | 4/1987 | Kurosaki |
| 4,681,024 | A | 7/1987 | Ivey |
| 4,726,559 | A | 2/1988 | Hultmark |
| 4,867,640 | A | 9/1989 | Penlesky |
| 5,232,152 | A | 8/1993 | Tsang |
| 5,620,370 | A | 4/1997 | Umai |
| 5,934,783 | A | 8/1999 | Yoshikawa |
| 6,161,175 | A | 12/2000 | Kim |
| 6,215,885 | B1 | 4/2001 | Geiger |
| 6,261,175 | B1 | 7/2001 | Larson |
| 6,329,908 | B1 | 12/2001 | Frecska |
| 6,340,237 | B1 | 1/2002 | Koga |
| D457,232 | S | 5/2002 | Miura |
| D457,616 | S | 5/2002 | Yamanaka |
| 6,384,352 | B1 | 5/2002 | Ellman et al. |
| 6,488,579 | B2 | 12/2002 | Larson |
| 6,538,881 | B1 | 3/2003 | Jeakins |
| 6,632,006 | B1 | 10/2003 | Rippel |
| 6,802,770 | B2 | 10/2004 | Larson |
| 6,897,580 | B2 | 5/2005 | White |
| 6,979,169 | B2 | 12/2005 | Penlesky |
| D521,145 | S | 5/2006 | Craw |
| 7,128,303 | B2 | 10/2006 | Penlesky |
| D535,433 | S | 1/2007 | Craw |
| 7,175,309 | B2 | 2/2007 | Craw |
| 7,203,416 | B2 | 4/2007 | Craw |
| D565,716 | S | 4/2008 | Jacak |
| D575,387 | S | 8/2008 | Zakula |
| D577,805 | S | 9/2008 | Adrian |
| D581,508 | S | 11/2008 | Miyake |
| 7,455,432 | B2 | 11/2008 | Craw |
| 7,455,500 | B2 | 11/2008 | Penlesky |
| 7,481,559 | B1 | 1/2009 | Rashidi |
| 7,591,867 | B2 | 9/2009 | Choi |
| 7,606,379 | B2 | 10/2009 | Ivey et al. |
| 7,654,495 | B2 | 2/2010 | Adrian |
| 7,677,964 | B1 | 3/2010 | Bucher |
| 7,845,803 | B2 | 12/2010 | Lv |
| 7,881,827 | B2 | 2/2011 | Park et al. |
| 7,922,335 | B2 | 4/2011 | Sakai |
| 7,993,037 | B1 | 8/2011 | Buse |
| D653,323 | S | 1/2012 | Jacak |
| 8,104,502 | B2 | 1/2012 | Nakata |
| D654,998 | S | 2/2012 | Zakula |
| 8,113,148 | B2 | 2/2012 | Chem |
| 8,172,655 | B2 | 5/2012 | Liu |
| 8,218,805 | B2 | 7/2012 | Hornback |
| 8,295,504 | B2 | 10/2012 | Ady et al. |
| D681,249 | S | 4/2013 | Tom |
| 8,485,696 | B2 | 7/2013 | Pringle et al. |
| 8,591,037 | B2 | 11/2013 | Nagumo |
| 8,961,126 | B1 | 2/2015 | Tom |
| 9,022,846 | B1 | 5/2015 | Tom |
| 9,028,212 | B1 * | 5/2015 | Tom ..... F04D 1/04 416/5 |
| 9,097,265 | B1 * | 8/2015 | Tom ..... F04D 29/626 |
| 9,103,104 | B1 | 8/2015 | Tom |
| 9,188,132 | B1 | 11/2015 | Tom |
| 2005/0006549 | A1 | 1/2005 | Liu |
| 2005/0111972 | A1 | 5/2005 | Penlesky |
| 2006/0172693 | A1 | 8/2006 | Lundquist |
| 2006/0199515 | A1 | 9/2006 | Lasko |
| 2007/0131827 | A1 | 6/2007 | Nevers |
| 2008/0261508 | A1 | 10/2008 | Deng |
| 2008/0318515 | A1 | 12/2008 | Yeung |
| 2009/0028372 | A1 | 1/2009 | Cerasuolo |
| 2009/0073702 | A1 | 3/2009 | Craw |
| 2009/0116189 | A1 | 5/2009 | Chang |
| 2009/0170421 | A1 | 7/2009 | Adrian |
| 2010/0009621 | A1 | 1/2010 | Hsieh |
| 2010/0171681 | A1 | 7/2010 | Cabanas et al. |
| 2010/0226139 | A1 | 9/2010 | Lynch |
| 2012/0250335 | A1 | 10/2012 | Nakano |
| 2012/0274767 | A1 | 11/2012 | Hornback |
| 2013/0084793 | A1 | 4/2013 | Yang et al. |
| 2013/0114826 | A1 | 5/2013 | Chang |

OTHER PUBLICATIONS

Tom, Lawrence, Listing of pending claims for U.S. Appl. No. 13/289,312, filed Nov. 4, 2011, 7 pages.

Tom, Lawrence, Office Action Summary mailed Oct. 22, 2014 for U.S. Appl. No. 13/042,992, filed Mar. 8, 2011, 16 pages.

Tom, Lawrence, Listing of pending claims for U.S. Appl. No. 13/042,992, filed Mar. 8, 2011, 7 pages.

Tom, Lawrence, Office Action mailed Jan. 8, 2015 for U.S. Appl. No. 13/233,700, filed Sep. 15, 2011, 25 pages.

Tom, Lawrence, Amendment Response filed Oct. 3, 2014 for U.S. Appl. No. 13/233,700, filed Sep. 15, 2011, 13 pages.

* cited by examiner

50/60 CFM BATH EXHAUST FANS WITH FLAPS/EARS THAT ALLOW HOUSINGS TO BE MOUNTED TO JOISTS

This application is a Continuation Patent Application of U.S. patent application Ser. No. 12/233,700 filed Sep. 15, 2011, now issued as U.S. Pat. No. 9,097,265, which claims the benefit of priority to U.S. Provisional Patent Application Ser. No. 61/383,813 filed Sep. 17, 2010. The entire disclosure of each of the applications listed in this paragraph are incorporated herein by specific reference thereto.

FIELD OF INVENTION

This invention relates to ventilation exhaust fans, and in particular to apparatus, systems and methods of 50/60 CFM ventilation exhaust fans for bathrooms with flaps/ears that allow the housings to mount directly to joists in a ceiling or wall.

BACKGROUND AND PRIOR ART

Various types of bathroom ventilation fans have been proposed over the years. See for example, U.S. Pat. No. 4,867,640 to Penlesky et al.; U.S. Pat. No. 4,510,851 to Sarnosky et al.; U.S. Pat. No. 6,261,175 to Larson et al.; U.S. Pat. No. 6,488,579 to Larson et al.; U.S. Pat. No. 6,802,770 to Larson et al.; U.S. Pat. No. 7,203,416 to Craw et al.; and U.S. Pat. No. 7,654,495 to Adrian et al.

There have been many problems with the prior art. For example, many bath fans are difficult to be installed into a ceiling since the housings cannot be easily attached to different locations of joists in the ceiling. If a joist is off center to the middle of the bathroom ceiling the bath fan is not easy to center in the room. Additionally, many of the bath fans have numerous parts which add extra manufacturing costs. And as a result a bath fan that requires assembly of the bath fan at a job site will incur undesirable extra labor and material costs to install. Additionally, many bath fans have to be wired to components inside of the housings which also requires extra expensive labor costs to make the connections onside during the installation of the bath fan.

Thus, the need exists for solutions to the above problems with the prior art.

SUMMARY OF THE INVENTION

A primary objective of the present invention is to provide exhaust fans, apparatus, systems and methods for bathrooms with flaps/ears on the housings with blowers that provide 50 (fifty) CFM (cubic feet of air per minute) of airflow.

A secondary objective of the present invention is to provide exhaust fans, apparatus, systems and methods for bathrooms with flaps/ears on the housings with blowers that provide 60 (sixty) CFM (cubic feet of air per minute) airflow.

A third objective of the present invention is to provide exhaust fans, apparatus, systems and methods for bathrooms with flaps/ears on single one-piece box shaped housings with blowers.

A fourth objective of the present invention is to provide exhaust fans, apparatus, systems and methods for bathrooms with flaps/ears on the housings with vertically mounted motors and blowers.

A fifth objective of the present invention is to provide exhaust fans, apparatus, systems and methods for bathrooms with flaps/ears on the housings with an internal mounted motor and blower without a separate blower housing.

A sixth objective of the present invention is to provide exhaust fans, apparatus, systems and methods for bathrooms with flaps/ears on the housings using two piece deflectors around a blower to direct airflow.

A seventh objective of the present invention is to provide exhaust fans, apparatus, systems and methods for bathrooms with flaps/ears on the housings with blowers formed from minimal components.

An exhaust fan embodiment can include a housing having closed side walls, an open top and open bottom, a blower wheel inside of the housing, a motor for running the blower wheel, the blower wheel being vertically oriented relative to the motor, and external flaps attached to an exterior of the housing for mounting the housings directly to joists and other structural members inside of a ceiling. The motor can be a 50 (fifty) CFM (cubic feet per minute) generating motor. The motor can be a 60 (sixty) CFM (cubic feet per minute) generating motor. The motor can be an open motor with C-frame.

The flaps can include a base plate fastened to an external side corner of the housing, and flap plate attached at an angle to the base plate, the flap plate having a fastening opening for mounting the housing to a joist. The flaps can include a hinge for allowing the flap plate to swing relative to the base plate. The fastening opening in the flap plate can include a keyhole shape.

The fan can include a removable mounting plate having the motor and the blower wheel pre-attached thereto, wherein the mounting plate with the motor and blower wheel are removable as a single piece from the inside of the housing. The removable mounting plate can include a central opening for extending the blower wheel down therethrough. The motor can include an open motor with C-frame.

The fan can include a curved plate member to direct airflow and minimize excess noise from air being moved from the blower wheel. The curved plate member can include at least two curved plates attached to one another in a curved arrangement about the blower wheel.

The fan can include tabs attached to the housing for allowing the bath fan to be leveled and/or flush mounted to a ceiling.

Another embodiment of the ceiling mounted exhaust fan, can include a housing having closed side walls, an open top and open bottom, a motor attached to an impeller in a vertical orientation, and a mount plate member with an opening therethrough, the plate member having edge portions mounted inside of the housing so that the motor when mounted to the plate member allows for the motor and impeller to extend through the opening in the mount member, wherein the mount with mounted motor and attached impeller are removable as a single unit from the housing.

The motor can be a 50 (fifty) CFM (cubic feet per minute) generating motor. The motor can be a 60 (sixty) CFM (cubic feet per minute) generating motor. The motor can be an open motor with C-frame.

The fan can include external flaps attached to an exterior of the housing for mounting the housings directly to structural members inside of a ceiling. The flaps can include a base plate fastened to an external side corner of the housing, and a flap plate attached at an angle to the base plate, the flap plate having a fastening opening for mounting the housing to a joist. The fan can include tabs attached to the housing for allowing the bath fan to be leveled onto a ceiling.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

50 CFM Bath Exhaust Fans with Flaps/Ears.

A list of the components for FIGS. 1-11 will now be described.

Figure 1:
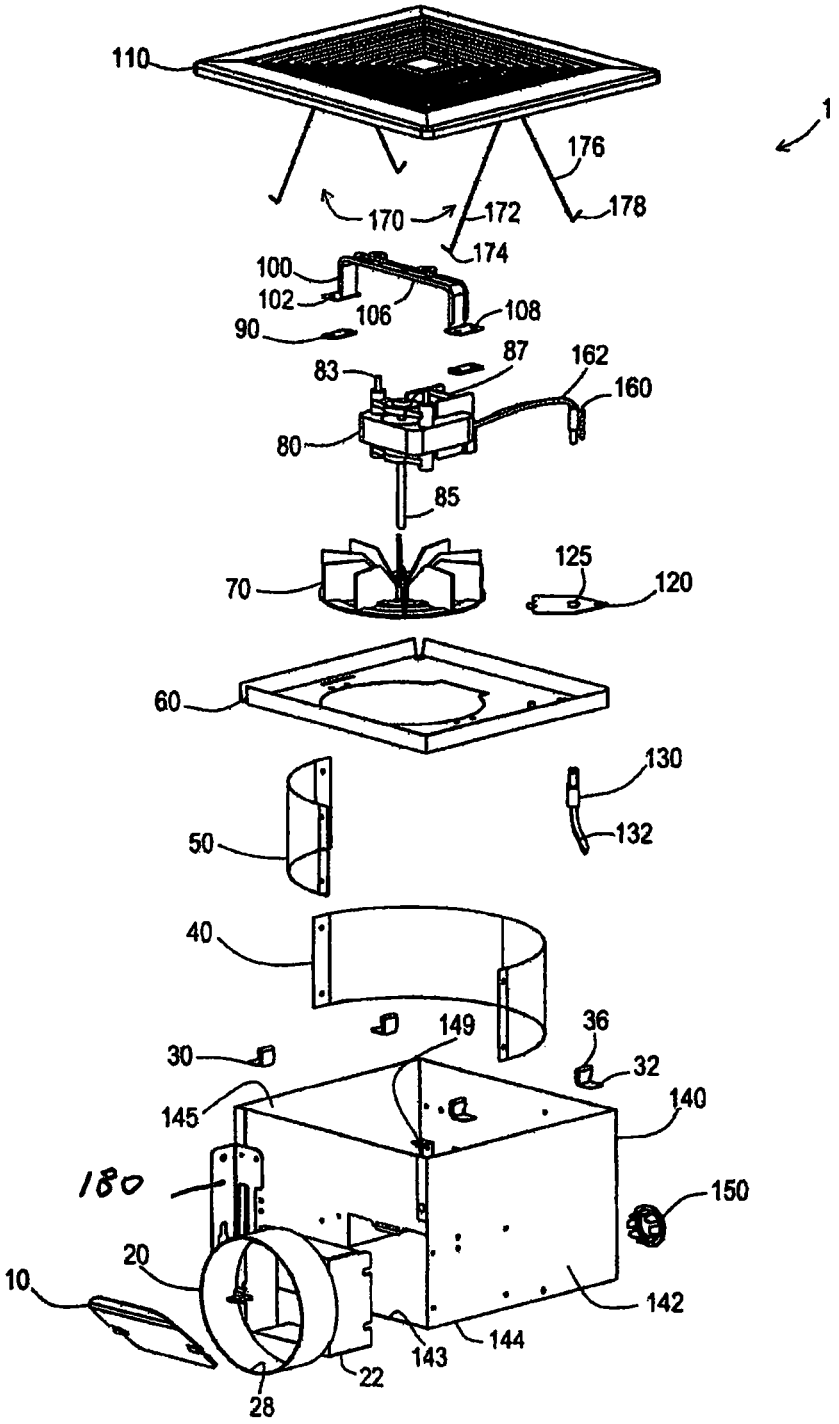
FIG. 1 is an exploded perspective view of a 60 CFM bath fan housing (with no heater) and motor separated from impeller and separate wind deflector shields.
Figure 2:
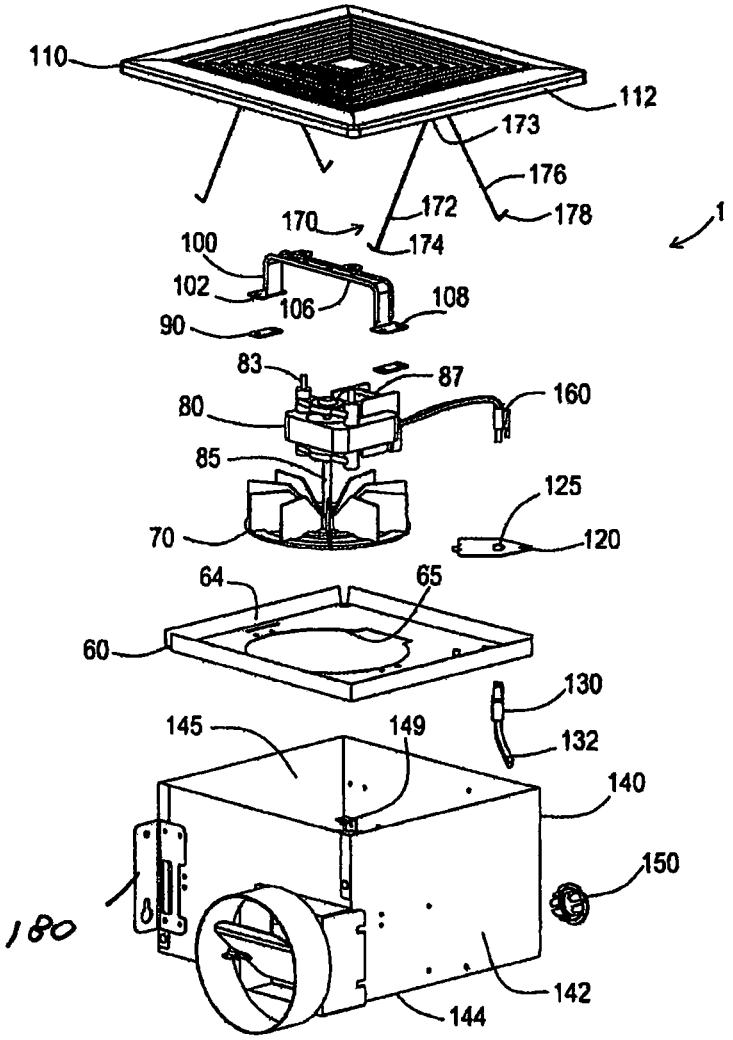
FIG. 2 is another exploded view of the 60 CFM bath fan housing of FIG. 1 with motor attached to impeller.
Figure 3:
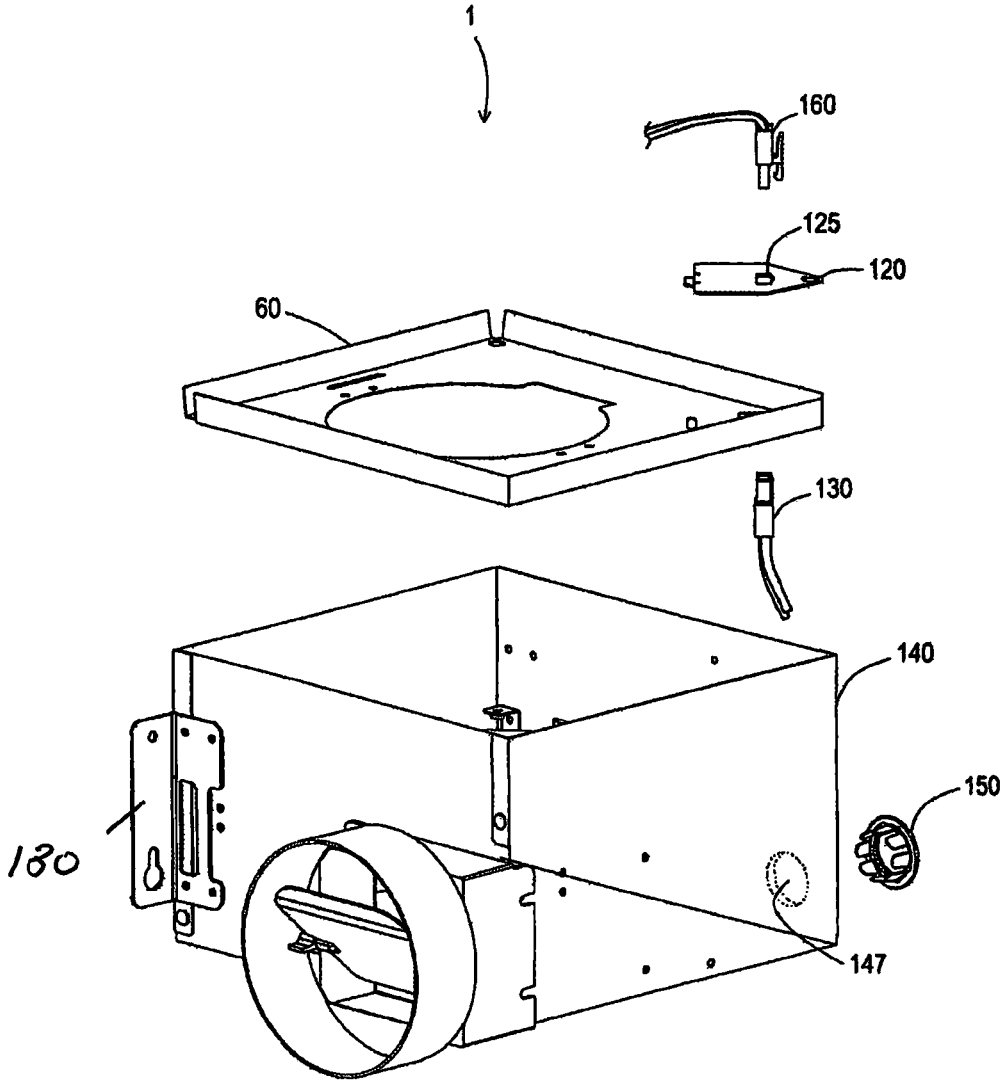
FIG. 3 is another exploded view of the 60 CFM bath fan housing of FIG. 1 showing separate male plug, female receptacle plug mounting plate and housing hole plug.

1. 50 CFM embodiment
10. Outlet damper plate
20. Outlet
22. male protruding inlet end
28. circular outlet end
30. Ceiling clip (4)
32. tab portions
36. clip mount (U shaped mount ends)
40. Wind Deflector (galvanized steel)
50. Wind Deflector (galvanized steel)
60. Motor mounting plate (galvanized steel)
70. Impeller (blower wheel)
80. Motor
83. fastener
87. fastener
90. rubber pad
100. Motor bracket
102. footer
106. midportion
108. footer
110. Grille assembly
120. Plug mounting plate
121. fastener
125. opening in plate
130. Female plug 2-pin
132. exterior electrical supply line
140. Housing assembly
142. closed sidewall(s)
143. rectangular outlet opening of housing
144. closed bottom
145. open top
147. side opening for power cord line
149. ledge clip(s)
150. Hole plug
160. male plug 2-pin
162. electrical line
170 spring clips
172. leg(s) of spring clips
173. apex(s) of spring clips
174. bent lower edge(s)
176. leg(s) of spring clips
178. bent lower edge(s)
180. flap ears (1-4)
190. joist(s)
200. ceiling FIG. 1 is an exploded perspective view of a 60 CFM bath fan housing (with no heater) 1 and electric motor 80 separated from impeller 70 and separate wind deflector shields 40, 50. FIG. 2 is another exploded view of the 60 CFM bath fan housing 1 of FIG. 1 with motor 80 attached to the impeller 70. FIG. 3 is another exploded view of the 60 CFM bath fan housing 1 of FIG. 1 showing separate male plug 160, female receptacle plug 130 mounting plate 120 and housing hole plug 150.

Figure 4:
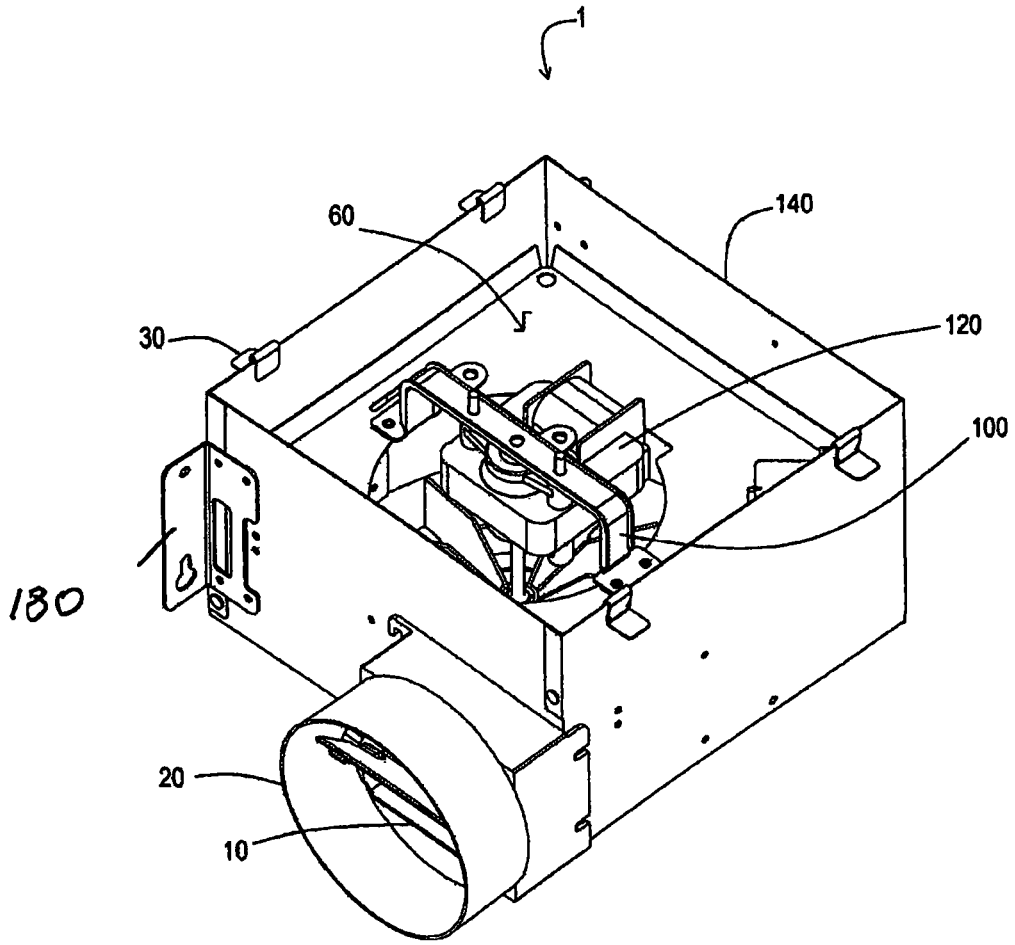
FIG. 4 is a partial assembled perspective view of the 60 CFM bath fan housing with interior mounted components without grill cover.
Figure 5:
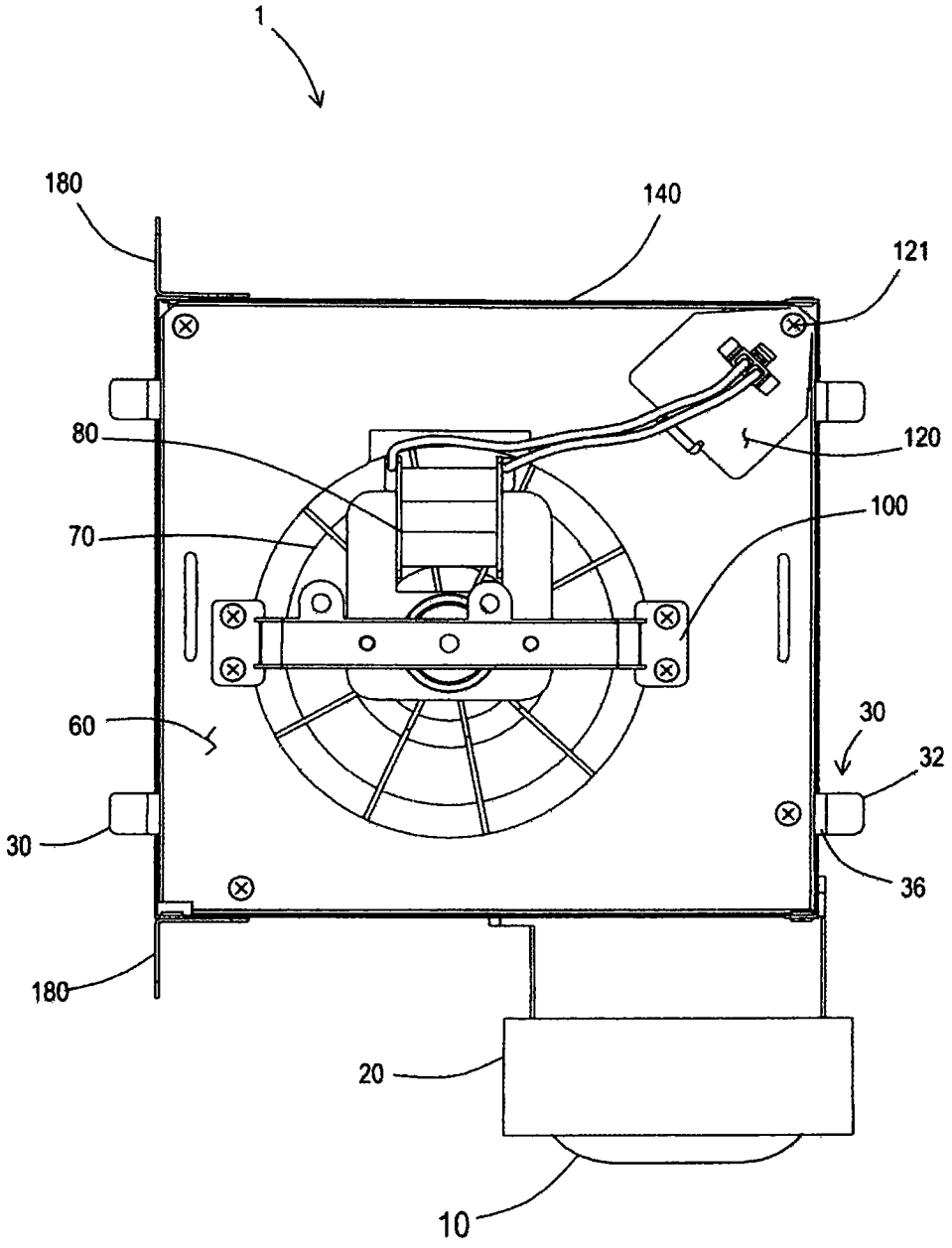
FIG. 5 is a top view of the partial assembled 60 CFM bath fan housing of FIG. 4 without grill cover.
Figure 6:
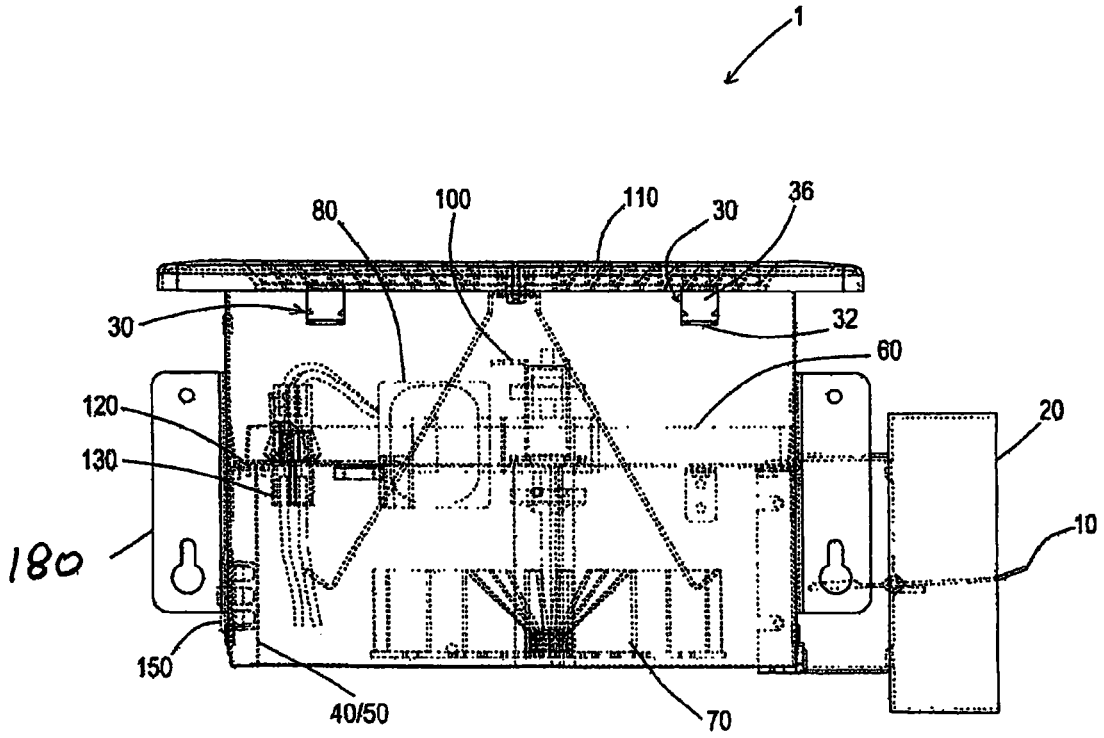
FIG. 6 is a cross-sectional side view of the assembled 60 CFM bath fan housing of FIGS. 4-5 with grill cover.

FIG. 4 is a partial assembled perspective view of the 60 CFM bath fan housing 1 with interior mounted components without grill cover 110. FIG. 5 is a top view of the partial assembled 60 CFM bath fan housing 1 of FIG. 4 without grill cover 110. FIG. 6 is a cross-sectional side view of the assembled 60 CFM bath fan housing 1 of FIGS. 4-5 with grill cover 110.

Figure 7:
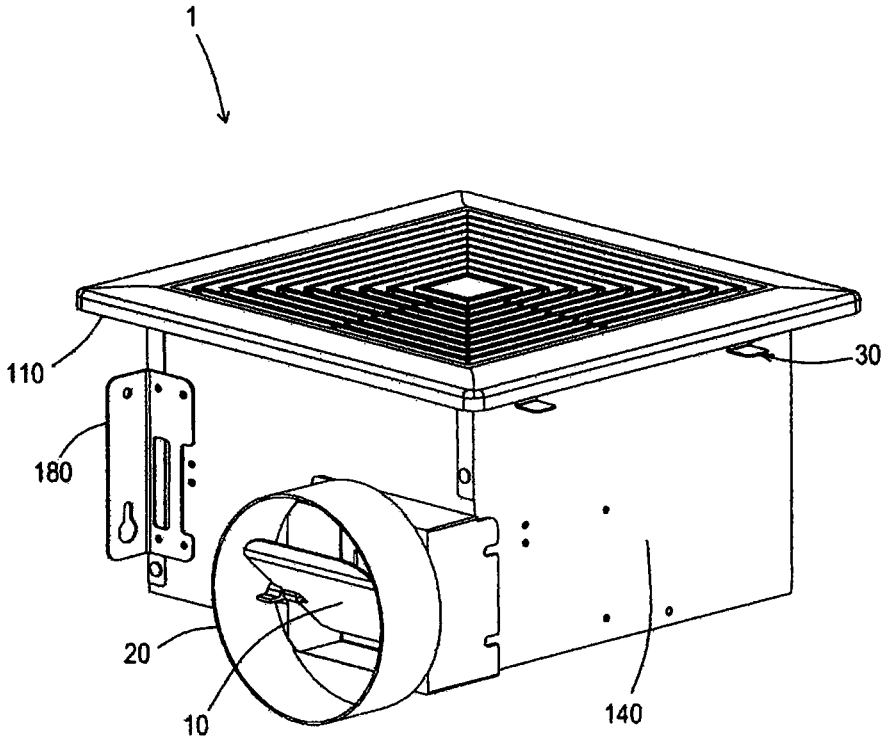
FIG. 7 is a perspective side view of the assembled 60 CFM bath fan housing of FIG. 6.
Figure 8:
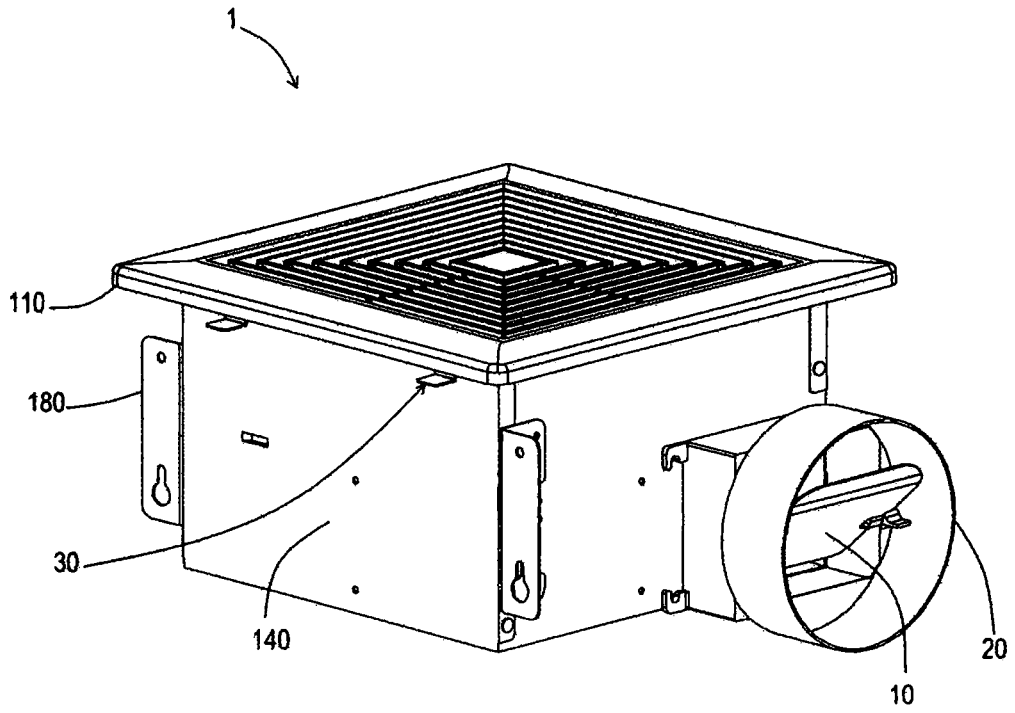
FIG. 8 is another perspective side view of the assembled 60 CFM fan housing of FIG. 6.
Figure 9:
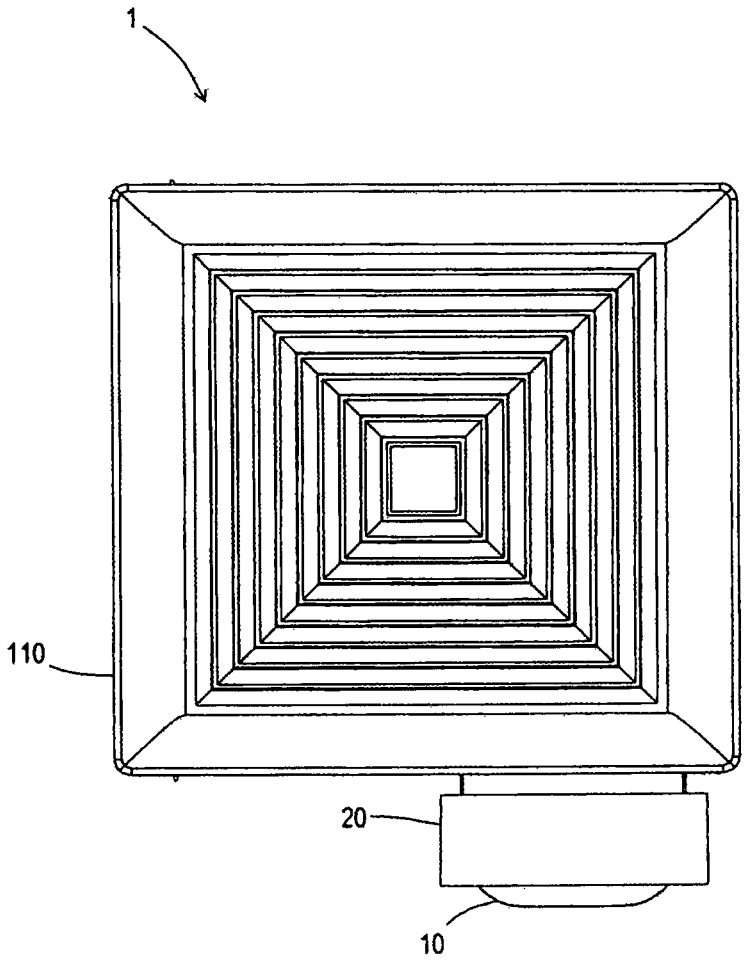
FIG. 9 is a top view of the assembled 60 CFM bath fan housing of FIGS. 6-8.

FIG. 7 is a perspective side view of the assembled 60 CFM bath fan housing 1 of FIG. 6. FIG. 8 is another perspective side view of the assembled 60 CFM fan housing 1 of FIG. 6. FIG. 9 is a top view of the assembled 60 CFM bath fan housing 1 of FIGS. 6-8.

Referring to FIGS. 1-9, the bath fan housing embodiment 1 can include a housing assembly 140 that can be formed from two or more preformed pieces that can be riveted together into a box shape having closed sidewalls 142, open top 145 and closed bottom 144. An exhaust outlet 20 can have a male protruding end 22 attached to a rectangular outlet opening 143 of the housing 140. A pivotal outlet damper plate 10 can be attached to the exterior opening 28 of the outlet 20

The motors 80 that can be used in these bath fans are C-frame electric motors. Opened meaning it is exposed and not encased in a metal casing like the 80 CFM, 90 CFM and 110 CFM bath fans. The electrical motor 80 can have a rotating axle portion 85 having an end that fits into central portion of an impeller 70. The impeller 70 can have a disc shaped base with blades perpendicular to and extending outward from a midportion therefrom.

The motor 80 with attached impeller 70 can be mounted to a mid portion of an inverted U-shaped motor bracket 100 by threadable fasteners 83, 87, such as screws and bolts that attach to the underside of a midportion 106 of the motor bracket 100. Together the bracket 100 with attached motor 80 and impeller 70 are attached to the upper surface of a motor mounting plate 60 by attaching footer(s) 102, 108 to an upper surface of the plate 60 by fasteners, such as screws, and bolts, or rivets, and the like. Antivibration and anti-noise members, 90 such as rubber pads, and the like, can be sandwiched between the footers 102, 108 and the upper surface of the mounting plate 60.

When attached the impeller 70 with motor 80 can extend through the middle opening 65 of the mounting plate 60. The mounting plate 60 can have bent side edges 64 which allow the mounting plate with mounted motor 80 and impeller 70 to be attached to interior sidewalls of the housing 140 by various removable type fasteners, such as screws and bolts, and the like. The edges 64 can sit on plural ledge clip(s) 149 arranged about an interior perimeter edge inside of the housing 140.

In a preferred embodiment, the impeller 70 and motor are preattached by the bracket 100 to the mounting plate 60 so that all of these components can be installed at once, and removed at once. The combined one piece motor/impeller/mount assembly allows inspectors, such as home inspectors, and the like to be able to visually see electrical connections by being able to insert and remove this one-piece assembly of components. Additionally, removing the combined plate 60 with bracket 100 mounted motor 80 and impeller 70 allows for replacement of parts, such as a burned out motor to be more easily accomplished after the fan has been installed.

To direct air from the rotating impeller 70 blades, a two piece combination of wind deflector components 40, 50 can be used. Each deflector 40 can be formed from metal such as but not limited to galvanized steel, having curved shapes that can be fastened together by rivets, and the like. The curved plates 40, 50 can be used to guide the airflow and minimizes excess noise. The attached deflectors 40, 50 can be positioned about the opening 65 below the plate 60 within the housing 140.

Before assembly, a removable plug 150 can be used to close off a side opening 147 in the housing 140. An external electrical power supply can be attached to an electrical line 132 that can pass through the side opening 147 in housing 140 to a female receptacle end 130 that can be within an opening 125 of a plug mounting plate 120 that can be attached by a fastener 121 such as a screw and the like, to cover an opening in the motor mount plate 60. The screw type fastener 121 on the top can loosen enabling the installer to slide the plate 120 for easy access to the wire connections. Motor 80 can be supplied with electrical power via electrical line 162 that is attached to a male plug 160 which can be mateably be attached to the female receptacle 130

A pair of grill clips 170 can springably hold the grill cover 110 to cover the top opening 145 of the blower housing 140. The pair of grill clips 170 can each be scissor clips each having an apex 173 that can attach to an inner protruding portion along the lower edge 112 of the grill cover 110. The cover 110 can be attached by pressing together the legs 172, 176 of the clips 170, so that the bottom bent edges 174, 178 of legs 172, 176 can be inserted to catch inside either side ledge portions 149 of housing 140 or into slot openings in the mount plate 60.

Referring to FIGS. 1-9, the invention can use ceiling clips 30 that can have a U-shaped mount end and a perpendicular extending tabs 32, where the mount ends 36 can attach about upper edges about the top opening 145 of the housing. These tabs 32 on the clips 30 can be used in case the ceiling is not flush so the tabs would level the bath fan. It is not always used.

Pre-attached to exterior side(s) 142 of the housing 140 can be flap ears 180 that can be L-shaped mount members having one leg pre-attached by fasteners such as screws, bolts, and rivets to an external corner of the housing 140, and a second perpendicular leg that can have openings, such as circular openings, and keyhole shaped openings for attaching the housing 1 to wood supports such as joists 190 behind a ceiling 200. The ear shape is very important, where the externally extending ear leg members can be rounded on the corners and it screws to the joist 190. Once a fastener is screwed tight the outer leg side with the ears 180 can be flush against the joist 190 and will not move. The ear flaps allow for flush mounting the bath fans 1 to the joists in less steps and using less parts than other types of mount members such as telescoping members, and the like. The flap ears can be rigid L shaped members. Alternatively, the flap ears can have a hinge between the housing mount leg, and the perpendicular extending ear leg portion, so that the flap ears are more versatile when mounting the housing inside of the ceiling.

Figure 10:
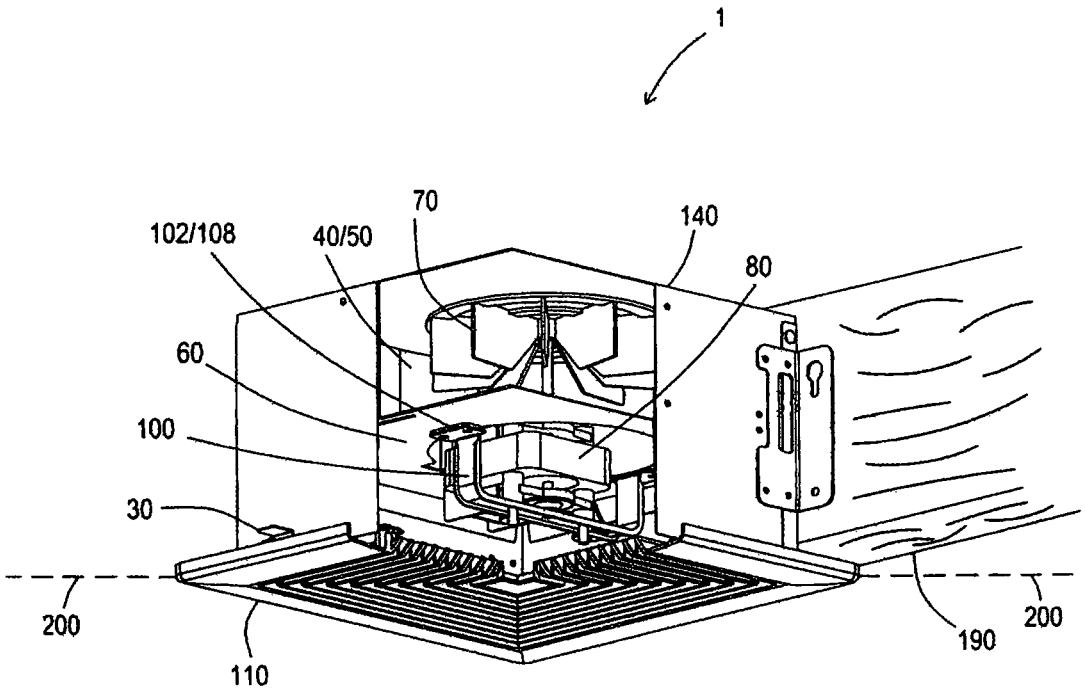
FIG. 10 is a side view of the assembled 60 CFM bath housing of FIGS. 6-9 with partial cut-away with housing mounted into the ceiling.
Figure 11:
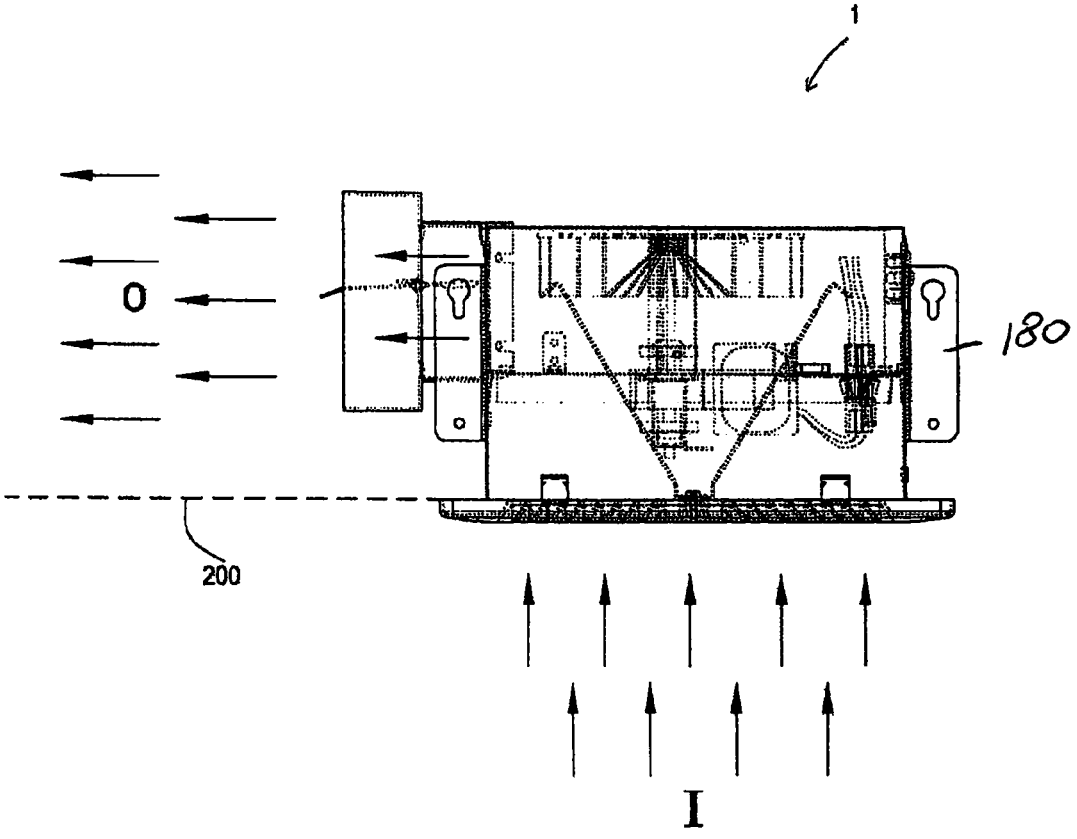
FIG. 11 is another side view of the ceiling mounted 60 CFM bath housing of FIG. 10 showing airflow direction into the housing and exhausted from the housing.

FIG. 10 is a side view of the assembled 60 CFM bath housing 1 of FIGS. 6-9 with partial cut-away with housing mounted into the ceiling. FIG. 11 is another side view of the ceiling mounted 60 CFM bath housing 1 of FIG. 10 showing airflow direction into the housing and exhausted from the housing 140.

While the preferred embodiment describes a 60 CFM fan, the invention can be practiced with a 50 CFM motor and the like.

Although the preferred embodiments describe the housings to be attached directly to joists in ceilings, the invention can apply to attaching the housings to structural members in walls, and other structural members behind ceilings and/or walls.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An exhaust fan, comprising:

a housing having side walls, a top and a bottom with an opening;

a blower inside of the housing;

a motor for running the blower; and at least one external flap adaptable for mounting the housing to a support member, wherein the flap includes a base plate with a flat front face and a flat rear face, the flat rear face fastened to an exterior of the housing, and a swinging flat flap plate, the swinging flat flap plate having a side attached by a hinge to a side of the base plate, the flap plate having a fastening opening for mounting the housing to the support member, wherein the flap plate is bendable from a coplanar position with the base plate to pivot about the hinge relative to the base plate.

2. The exhaust fan of claim 1, wherein the motor is a 50 (fifty) CFM (cubic feet per minute) generating motor.

3. The exhaust fan of claim 1, wherein the motor is a 60 (sixty) CFM (cubic feet per minute) generating motor.

4. The exhaust fan of claim 1, wherein the motor includes: an open motor with C-frame.

5. The exhaust fan of claim 1, wherein the fastening opening includes:

an opening and a keyhole slot.

6. The exhaust fan of claim 1, further comprising:

a removable mounting plate having a central opening therethrough with the motor and the blower pre-attached to the mounting plate the mounting plate attached by removable fasteners to internally facing side portions along the side walls between the top and the bottom, the motor being substantially on one side of the plate and the blower being substantially on an opposite side of the plate with a rotatable axle portion which attaches the motor to the impeller, wherein the mounting plate with the motor and blower are removable as a single piece from the inside of the housing by removing the removable fasteners.

7. The exhaust fan of claim 6, wherein the internally facing side portions includes:

side ledge clips, and the mounting plate sits on the side ledge clips and the removable fasteners are selected from screws and bolts.

8. The exhaust fan of claim 1, wherein the base plate is a single base plate.

9. The exhaust fan of claim 1, wherein the flap plate is a singular rectangular flap plate.

10. A ceiling mounted exhaust fan, comprising:

a housing having side walls, an exhaust side opening, a top and a bottom with an opening, the top being parallel to and adapted to be above a ceiling, with the bottom adjacent to an opening in the ceiling;

a motor attached to an impeller, both inside of the housing; and at least one external flap adaptable for mounting the housing to a support, wherein the flap includes a base plate with a flat front face and a flat rear face, the flat rear face fastened to an exterior of the housing, and a swinging flap plate with a flat front face and a flat rear face, the swinging flap plate having one side attached by a hinge to one side of the base plate, the flap plate having an opening for mounting the housing to the support, wherein the flap plate is bendable from a coplanar position with the base plate to pivot about the hinge relative to the base plate.

11. The exhaust fan of claim 10, wherein the motor is a 50 (fifty) CFM (cubic feet per minute) generating motor.

12. The exhaust fan of claim 10, wherein the motor is a 60 (sixty) CFM (cubic feet per minute) generating motor.

13. The exhaust fan of claim 10, wherein the fastening opening includes:

an opening and a keyhole slot.

14. The exhaust fan of claim 10, wherein the flap plate is a singular rectangular flap plate.

15. A ceiling exhaust fan, comprising:

a housing having side walls, a side exhaust, a top above and parallel to a ceiling in which the exhaust fan is adapted to be installed, and a bottom with an opening therethrough adjacent to an opening in the ceiling;

a blower wheel inside of the housing;

a motor for running the blower wheel; and at least one external flap adaptable for mounting the housing to a support, wherein the flap includes a base plate having a flat front face and a flat rear face, the flat rear face fastened to an exterior of the housing, and a swinging flap plate having a side attached by a hinge to one side of the base plate, the flap plate having an opening for mounting the housing to the support, wherein the flap plate is bendable from a coplanar position with the base plate to pivot relative to the base plate.

16. The ceiling exhaust fan of claim 15, wherein the flap plate is a singular rectangular flap plate.

17. The ceiling exhaust fan of claim 15, wherein the fastening opening includes:

an opening and a keyhole slot.

* * * * *